US008807672B2

(12) United States Patent
Gasser

(10) Patent No.: US 8,807,672 B2
(45) Date of Patent: Aug. 19, 2014

(54) DRAWER PULL-OUT GUIDE ELEMENT

(71) Applicant: Julius Blum GmbH, Hochst (AT)

(72) Inventor: Ingo Gasser, Hochst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 14/065,874

(22) Filed: Oct. 29, 2013

(65) Prior Publication Data

US 2014/0055020 A1 Feb. 27, 2014

Related U.S. Application Data

(63) Continuation of application No. PCT/AT2012/000076, filed on Mar. 23, 2012.

(30) Foreign Application Priority Data

May 5, 2011 (AT) ..... A 627/2011

(51) Int. Cl.
*A47B 95/00* (2006.01)
*A47B 88/16* (2006.01)
*A47B 88/04* (2006.01)

(52) U.S. Cl.
CPC ..... *A47B 88/16* (2013.01); *A47B 88/0422* (2013.01)
USPC ..... 312/333

(58) Field of Classification Search
USPC ..... 312/330.1, 333, 334.1, 334.4–334.8, 312/334.14, 334.44, 334.46
See application file for complete search history.

(56) References Cited

U.S. PATENT DOCUMENTS 5,281,021 A 1/1994 Rock et al.
5,364,180 A * 11/1994 Berger ..... 312/334.14
5,580,139 A * 12/1996 Grabher ..... 312/333
5,632,541 A 5/1997 Uthoff
6,036,291 A * 3/2000 Rock ..... 312/333

(Continued)

FOREIGN PATENT DOCUMENTS

AT 401 001 5/1996
DE 92 04 846 6/1992

(Continued)

OTHER PUBLICATIONS

International Search Report (ISR) dated Jul. 2, 2012 in International (PCT) Application No. PCT/AT2012/000076.

(Continued)

*Primary Examiner* — Matthew Ing
(74) *Attorney, Agent, or Firm* — Wenderoth, Lind & Ponack, L.L.P.

(57) ABSTRACT

A drawer pull-out guide has a body rail to be attached to a furniture body, a drawer rail to be attached to the drawer and which is mounted such that it can move relative to the body rail, and a locking apparatus arranged on the drawer rail so that the drawer can be releasably locked relative to the drawer rail. The locking apparatus has at least one latching part mounted so that it can be moved between an arrest position, which locks the drawer, and a release position, which releases the drawer. A carrier rail is premounted on the drawer, and the carrier rail has, in cross section, a portion which has a V-shape and has two vertically running limbs. This portion of the carrier rail surrounds the drawer rail, and the latching part of the locking apparatus can be releasably latched to a limb of the carrier rail.

15 Claims, 9 Drawing Sheets

(56) References Cited

U.S. PATENT DOCUMENTS

| | | | | |
|---|---|---|---|---|
| 7,320,508 | B2 | 1/2008 | Booker et al. | |
| 7,695,080 | B2 * | 4/2010 | Chen et al. | 312/333 |
| 8,056,994 | B2 * | 11/2011 | Chen et al. | 312/334.6 |
| 8,366,218 | B2 * | 2/2013 | Janzen et al. | 312/334.1 |
| 2004/0095047 | A1 * | 5/2004 | Salice | 312/332.1 |
| 2004/0227440 | A1 | 11/2004 | Booker et al. | |
| 2009/0212679 | A1 | 8/2009 | Frousiakis et al. | |
| 2010/0278588 | A1 | 11/2010 | Jaekel | |
| 2011/0068670 | A1 * | 3/2011 | Ritter | 312/334.1 |

FOREIGN PATENT DOCUMENTS

| | | |
|---|---|---|
| DE | 198 28 718 | 12/1999 |
| DE | 100 22 084 | 11/2001 |
| DE | 20 2005 005 489 | 6/2005 |
| DE | 20 2007 006 549 | 8/2007 |
| EP | 0 421 458 | 4/1991 |
| EP | 2 245 963 | 11/2010 |
| WO | 95/02349 | 1/1995 |
| WO | 2004/110213 | 12/2004 |
| WO | 2010/040273 | 4/2010 |

OTHER PUBLICATIONS

Austrian Patent Office Search Report (ASR) issued Dec. 16, 2011 in Austrian Patent Application No. A 627/2011.

* cited by examiner

DRAWER PULL-OUT GUIDE ELEMENT

BACKGROUND OF THE INVENTION

The invention concerns an arrangement having a drawer and a drawer extension guide. The drawer extension guide has a carcass rail to be fixed to a furniture carcass, a drawer rail which is to be fixed to the drawer and which is mounted displaceably relative to the carcass rail, and a locking device which is arranged on the drawer rail and by which the drawer is releasably lockable relative to the drawer rail. The locking device has at least one latching portion which is mounted movably by way of a gripping element between an arresting position of locking the drawer and a release position of releasing the drawer.

The invention further concerns an arrangement having a drawer and a drawer extension guide of the kind to be described.

In accordance with the state of the art locking devices are known, by which a drawer in its entirety can be fitted to or removed from the drawer rail of a drawer extension guide without the use of a tool so that the drawer—for example for cleaning purposes—can be completely released from the drawer extension guide and re-fixed thereto. In that case, the drawer extension guide is pre-mounted to the article of furniture, whereupon the drawer for mounting thereof is placed onto the drawer rail and pushed rearwardly until automatic latching of a latching portion with the drawer rail which is in the closed position takes place.

Examples of such a fixing option are described in EP 0 421 458 B1 and in DE 20 2007 006 549 U1 to the present applicant. In those cases, latching is effected by resilient latching portions whose displaced abutment surfaces are successively latched in a recess in the drawer rail, thereby implementing automatic latching with a steady reduction in the play between the drawer and the drawer rail.

Those locking devices are usually arranged at the underside of a drawer bottom and are screwed to the drawer bottom and/or to the drawer front panel. Mounting of the locking device has to be effected in an accurate position so that the position of the latching portion in the mounted position can exactly co-operate with a recess or latching edge of the drawer rail. Qualified personnel and suitable care is therefore required for that fitment procedure.

Locking devices arranged on the drawer rail of a drawer extension guide are to be seen for example in AT 401 001 B, DE 198 28 718 A1, DE 100 22 084, WO 95/02349, DE 92 04 846 U1, EP 2 245 963 A1 and US 2009/0212679 A1. In those structures, on the one hand, the drawer has to be additionally processed (for example latching recesses in the drawer side wall), while on the other hand, the latching portion is considerably loaded by the load of the drawer, and that makes manual locking and unlocking more difficult.

SUMMARY OF THE INVENTION

It is therefore an object of the present invention to develop an arrangement of the general kind set forth in the opening part of this specification, avoiding the above-mentioned disadvantages, so that mounting of the drawer relative to the drawer extension guide is facilitated.

According to the invention, a carrier rail is pre-mounted to the drawer, which carrier rail in cross-section has a portion of a U-shaped profile with two vertically extending limbs. The portion of the carrier rail in the mounted position embraces the drawer rail from above, and the latching portion of the locking device is releasably latchable to a limb of the carrier rail.

By fitting a carrier rail to the drawer, the carrier rail can firstly be guided in the mounting procedure precisely in the longitudinal direction of the drawer rail, the two vertically extending limbs guiding the drawer in a lateral direction. Latching of the latching portion to a vertically extending limb of the carrier rail provides that the latching portion can also be relieved of the load of the drawer and independently of its load condition, whereby locking or unlocking of the latching portion is to be implemented practically without any forces. By virtue of relieving the latching portion of the load on the drawer, the risk of breaking the locking device can also be substantially reduced.

The drawer rail can also be provided as from the factory with the locking device so that therefore the relevant functional parts of the locking unit no longer have to be screwed to the drawer on site. It is also possible for the drawer extension guide and the locking device to be offered as a set, wherein the locking device can be mounted as a retro-fit structural unit to the drawer rail—for example by a snap-action connection. It is therefore sufficient if the drawer has a recess or a latching edge which in the mounted position co-operates with the latching portion of the locking device. In that way it is possible to completely eliminate on site components which are to be fitted separately.

In a preferred embodiment the locking device is mounted to a front end region of the drawer rail.

In one embodiment, the gripping element can be mounted pivotably relative to the drawer rail. It is, however, also possible for the gripping element to be in the form of a linearly displaceable slider. The gripping element can be mounted laterally to the drawer rail in order to make it possible to easily reach it for manual actuation. The gripping element can be of a resilient nature, and in the rest position can project inclinedly from the drawer rail.

To achieve a compact structure, the gripping element can be in one piece with the latching portion.

In a further embodiment, the locking device has at least one inclined run-in portion by which the drawer can be guided in mounting thereof in a lateral direction relative to the drawer rail. Thus, on the one hand, exact lateral positioning of the drawer relative to the drawer rail is possible, while on the other hand this introduction aid prevents the outside of the drawer side wall contacting the metal mounting flange of the carcass rail, which flange is fixed to the side wall of the furniture carcass, in fitment of the drawer. More specifically, if the drawer side wall has a delicate surface, it could suffer damage by sliding along against that mounting flange, and that is effectively prevented by the inclined run-in portion provided.

The latching portion can be resilient in nature or can be acted upon by a spring, in which case automatic latching of the latching portion relative to the drawer is possible. The latching portion can have at least one latch which in the arresting position of locking the drawer co-operates with a recess or with a latching edge of a carrier rail pre-mounted to the drawer. The latching portion can be moved out of that arresting position by manual actuation of the gripping element in opposition to the resilient action of the latching portion, whereby the drawer is released relative to the drawer rail.

In another embodiment, the locking device in its entirety can be made in one piece from plastic material, in which case inexpensive manufacture is possible using an injection molding process.

BRIEF DESCRIPTION OF THE DRAWINGS

Further details and advantages will be apparent from the specific description hereinafter. In the drawings.

DETAILED DESCRIPTION OF THE INVENTION

Figure 1:
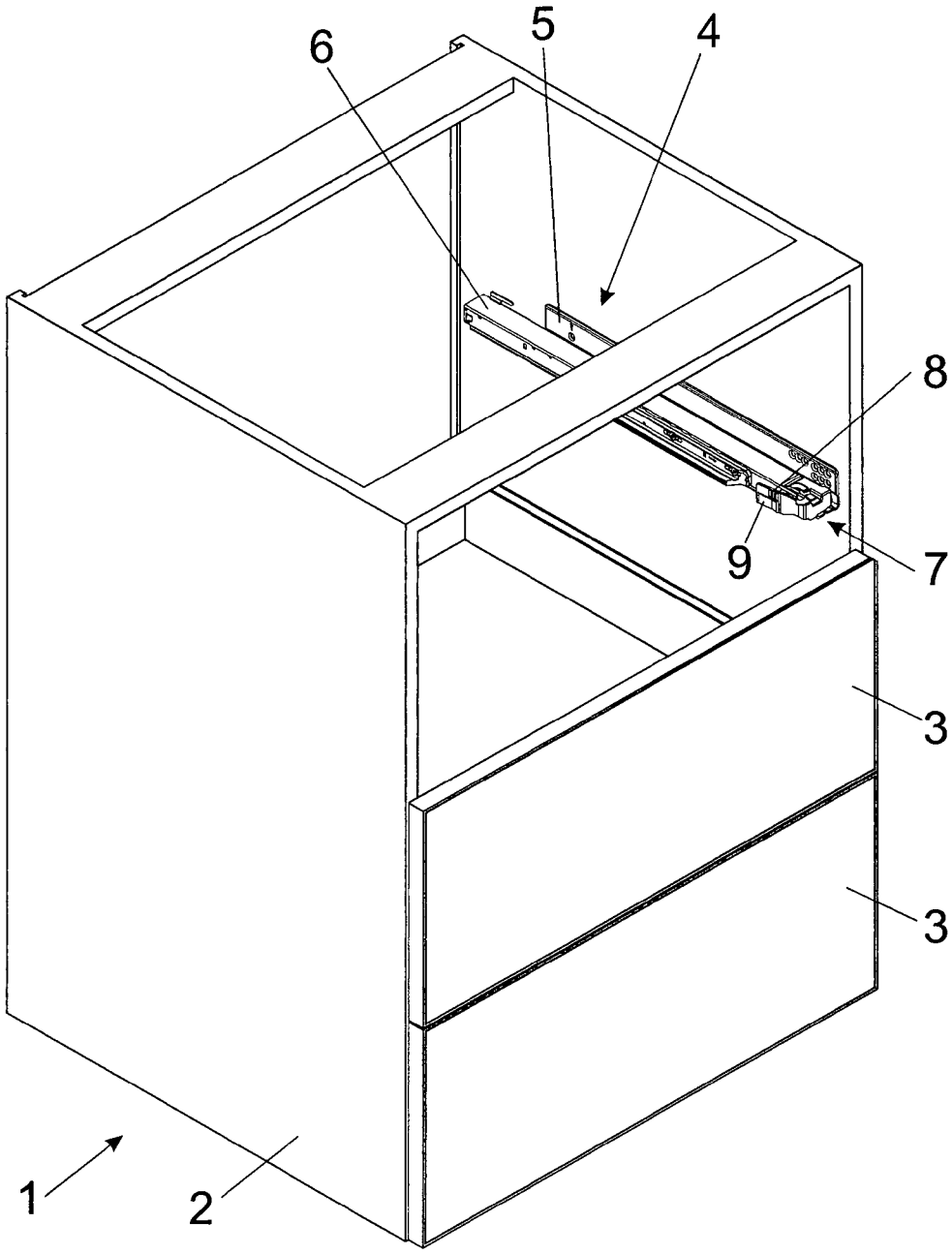
FIG. 1 shows a perspective view of an article of furniture having a furniture carcass and displaceable drawers.

FIG. 1 shows an article of furniture 1 with drawers 3 which are mounted displaceably relative to a furniture carcass 2 in cabinet form. Mounted to the two opposite side walls of the furniture carcass 2 are respective drawer extension guides 4 which have a carcass rail 5 to be fixed to the furniture carcass 2 and a drawer rail 6 which is displaceable relative to the carcass rail 5. To provide a full pull-out extension arrangement, a displaceably mounted central rail can also be arranged between the stationary carcass rail 5 and the extendable drawer rail 6. For fixing the drawer 3 relative to the drawer rail 6, a locking device 7 is mounted to a front end region of the drawer rail 6. For locking the drawer 3, the locking device 7 has a latching portion 8 while a gripping element 9 is provided to release the locking action.

Figure 2:
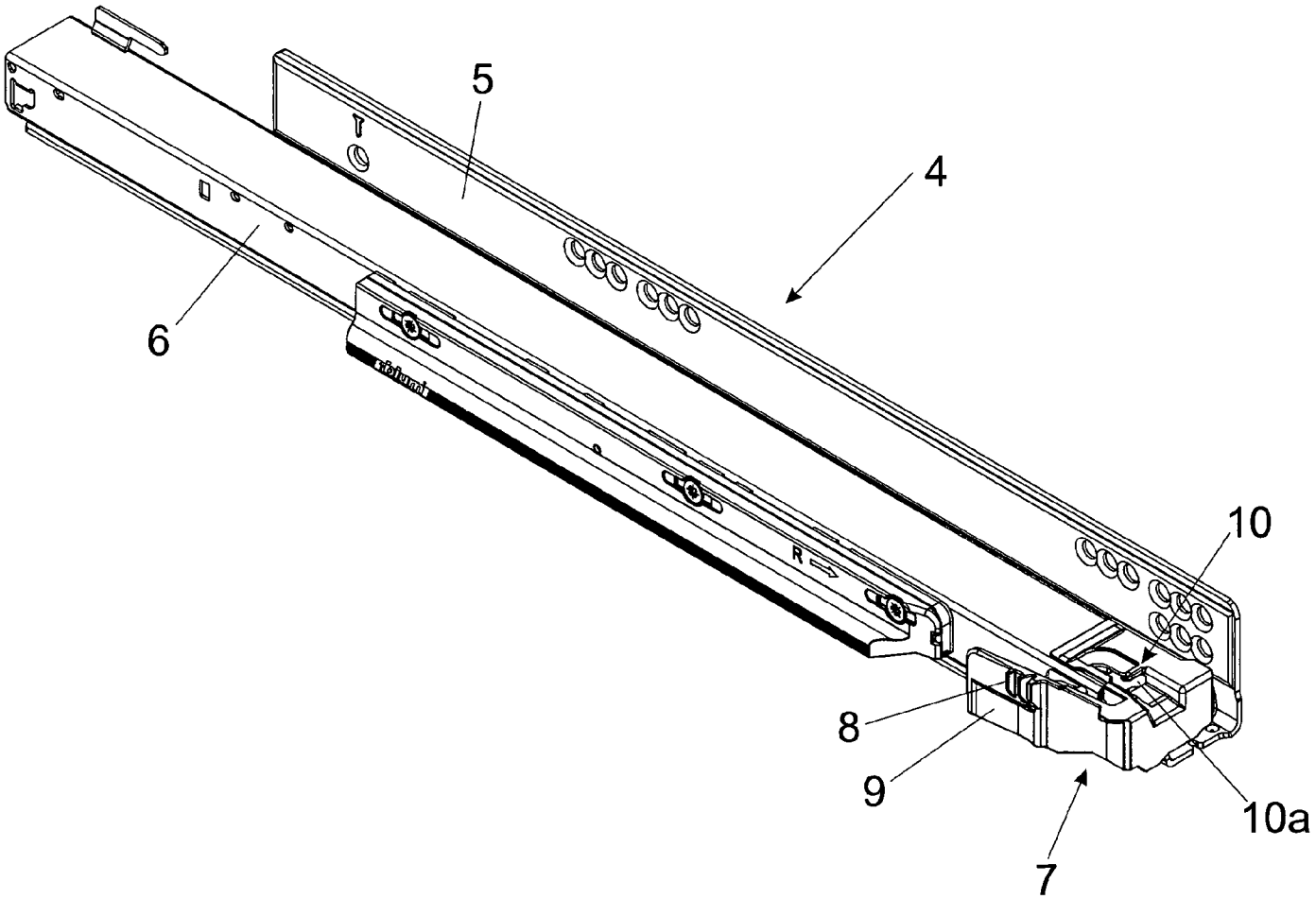
FIG. 2 shows a perspective view of a drawer extension guide.

FIG. 2 shows a perspective view of the drawer extension guide 4. The carcass rail 5 is to be fixed to the furniture carcass 2, while the locking device 7 which is mounted to the drawer rail 6 is provided for releasable connection to a drawer 3. The locking device 7 forms the front termination of the drawer rail 6, whereby the sensitive movement control means of the drawer extension guide 4 (running carriage, carriage control means, rolling bodies and so forth) is protected from the ingress of dirt. For locking the drawer 3, the locking device 7 has a latching portion 8 mounted movably between an arresting position of locking the drawer 3 and a release position of releasing the drawer 3, by a gripping element 9 to be actuated manually. The locking device 7 further includes a lifting prevention member 10 having an insertion opening 10*a* adapted for the insertion of a pin connected to the drawer 3. The lifting prevention member 10 prevents unwanted lifting movement of the front end region of the drawer 3 relative to the drawer rail 6 in the mounted position.

Figure 3:
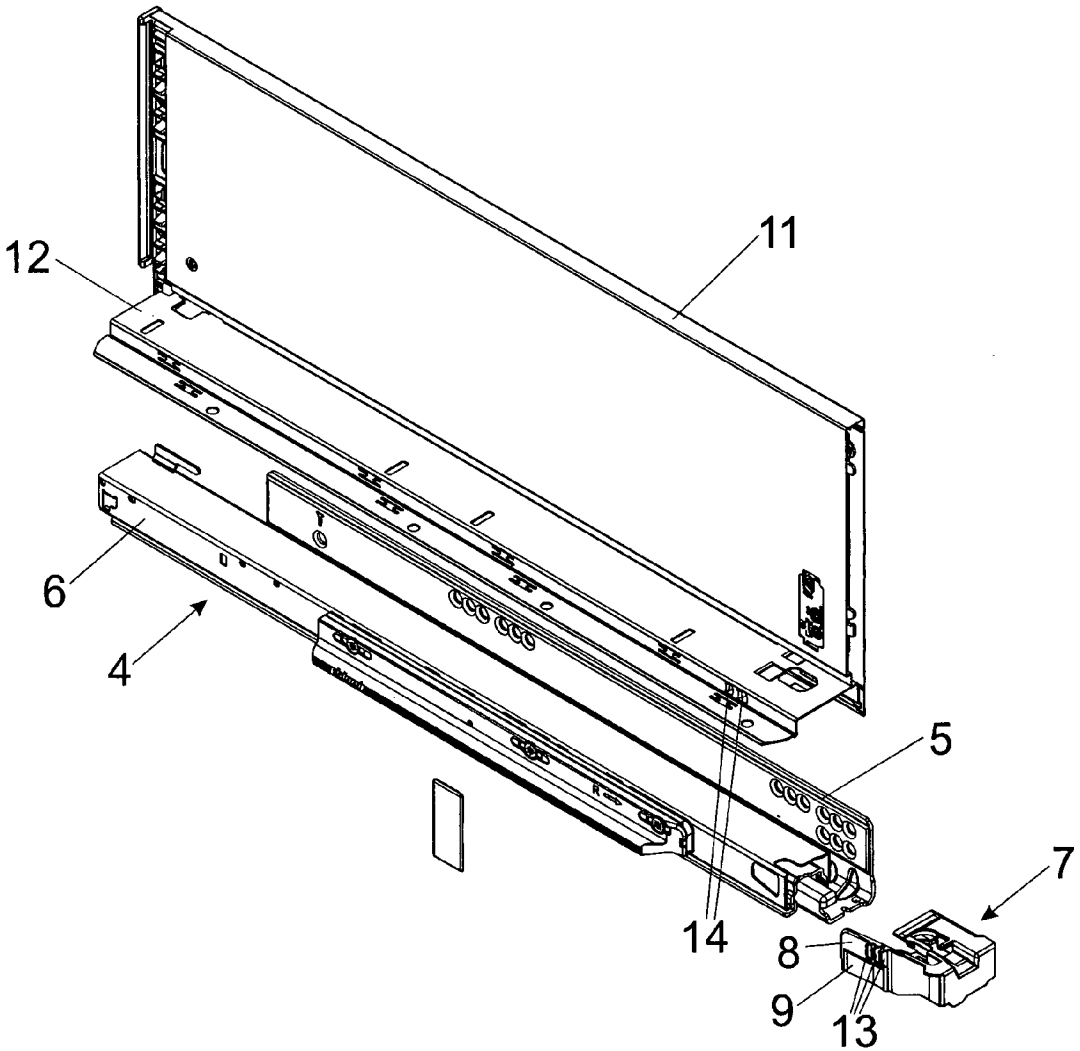
FIG. 3 shows the drawer extension guide with the locking device and a drawer side wall with a carrier rail in an exploded view.

FIG. 3 shows the drawer extension guide 4, the locking device 7, and a drawer side wall 11 with a carrier rail 12 connected thereto in an exploded view, the carrier rail 12 being provided as a support for a drawer bottom. The locking device 7 is injection-molded in its entirety in one piece from plastic material and is fitted onto the front end of the drawer rail 6. In cross-section, the carrier rail 12 has a U-shaped profile which in the mounted position embraces the drawer rail 6 from above. The latching portion 8 of the locking device 7 is provided with at least one latch 13 which, in the arresting position of arresting the drawer 3, co-operates with a latching element such as a recess in carrier rail 12 or a latching edge 14 of the carrier rail 12. In the illustrated embodiment, the latching portion 8 has a plurality of latches 13 which are displaced in the longitudinal direction of the drawer rail 6 and which can co-operate with a plurality of latching edges 14 displaced in the longitudinal direction of the carrier rail 12. In that way, the drawer 3 can be releasably latched by the carrier rail 12 at a plurality of predetermined latching positions relative to the drawer rail 6.

Figure 4A:
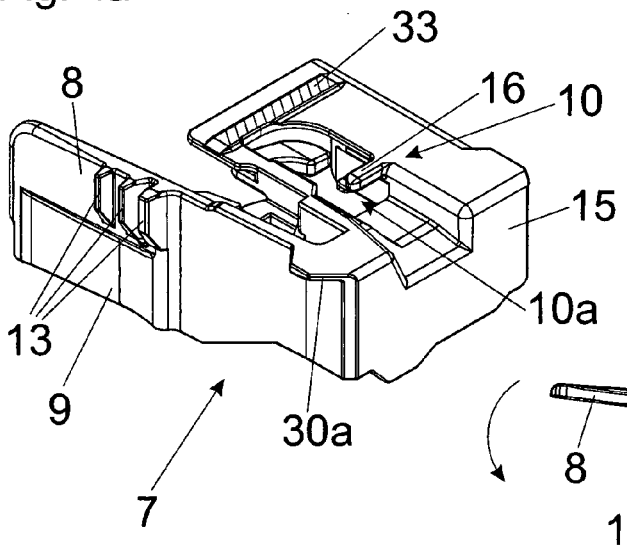
FIGS. 4*a*, 4*b* show two different views of the locking device.

FIG. 4*a* shows a perspective view of the locking device 7 to be fixed to the drawer rail 6. The locking device 7 has a main body 15 which carries the gripping element 9 and the latching portion 8 with the latches 13. The lifting prevention member 10 includes the insertion opening 10*a* which is delimited at the bottom by the main body 15 and at the top by a horizontally extending leg 16. The insertion opening 10*a* is provided for the insertion of a pin—which is preferably arranged on the carrier rail 12—so that the leg 16 prevents lifting of the pin (and thus lifting of the drawer 3) in the mounted position. The locking device 7 has at least one inclined run-in portion 30*a* by which the carrier rail 12 (and therewith the drawer 3) can be guided in the mounting procedure in a lateral direction relative to the drawer rail 6. The locking device 7 has at the top side a support portion 33 for supporting the drawer 3, whereby the drawer 3 does not rest over the entire length on the drawer rail 6. When now the drawer 3 is displaced at its rear side in the height-wise direction by a per se known adjusting device, the support portion 33 serves at the same time as a pivot axis for the drawer 3. A height-wise adjustment at the rear side of the drawer 3 also allows that the front region of the drawer 3 (and thus the front panel for adjustment of the inclination thereof) can also be pivoted or tilted about that support portion 33 which extends transversely relative to the longitudinal extent of the drawer rail 6.

Figure 4B:
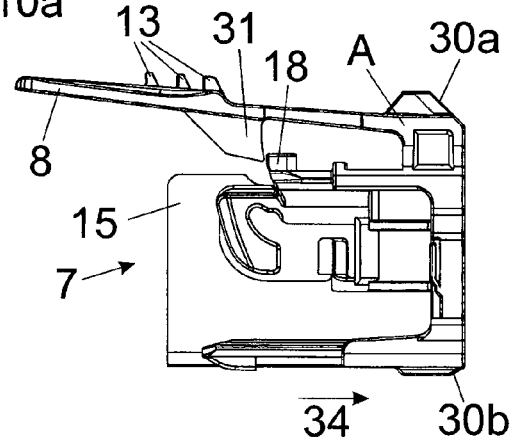

FIG. 4*b* shows a plan view of the locking device 7, wherein the gripping element 9 (and therewith the latching portion 8) is pivotable or bendable about a perpendicularly extending notional axis (A). To unlock the drawer 3, the gripping element 9 is pivoted about the axis (A) in the direction indicated by the arrow towards the main body 15 whereby the latching portion 8 is moved into a release position and thus the drawer 3 is released relative to the drawer rail 6. For improved guidance and support of the latching portion 8, a slide element 31 can be slidingly supported at a stationary guide 18 of the main body 15. The support for the slide element 31 on the guide 18 also has the advantage that, when the mounted drawer 3 is manually pulled in the extension direction 34, the force does not act on the pivot axis (A), but the flow of force is diverted to the main body 15 and the drawer rail 6, thereby considerably reducing the risk of breakage of the locking device 7 in the region of the pivot axis (A). Provided at both sides of the main body 15 are inclined run-in portions 30*a* and 30*b* provided for lateral guidance of the drawer 3 upon mounting thereof.

Figure 5A:
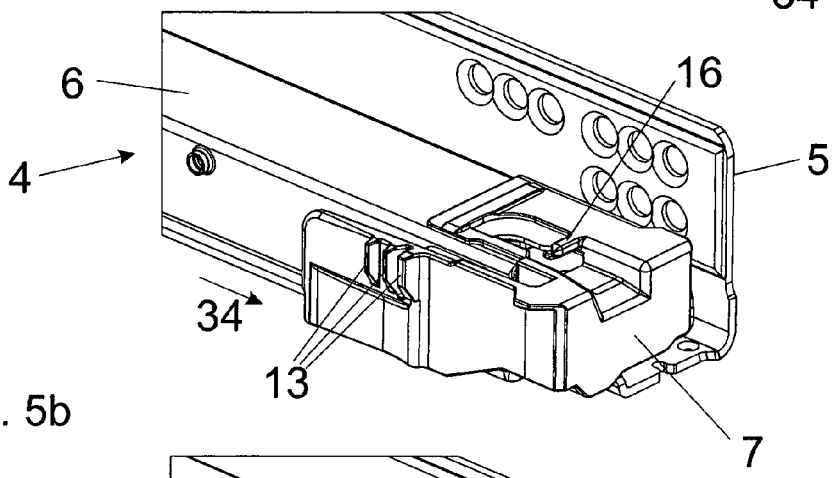
FIGS. 5*a*, 5*b* show the front end region of the drawer rail with the locking device and with a carrier rail coupled thereto.

FIG. 5*a* shows a perspective view of the front region of the drawer extension guide 4, the locking device 7 being mounted at the front end of the drawer rail 6. The carrier rail 12 can be fixed in different depthwise positions relative to the drawer rail 6 by way of the latches 13 which are arranged offset in the longitudinal direction of the drawer rail 6.

Figure 5B:
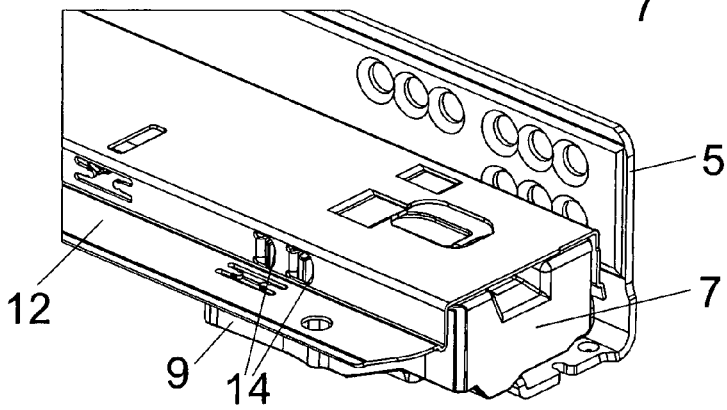

FIG. 5*b* shows a perspective view of the front end region of the drawer extension guide 4, in which the carrier rail 12 pre-mounted to the drawer 3 is connected to the drawer rail 6 by the locking device 7. The latches 13 shown in FIG. 5*a* co-operate with the latching edges 14 of the carrier rail 12 in the arresting position. The locking action between the carrier rail 12 and the drawer rail 6 can be released again by manually applying pressure to the gripping element 9 in the direction of the drawer rail 6.

Figure 6:
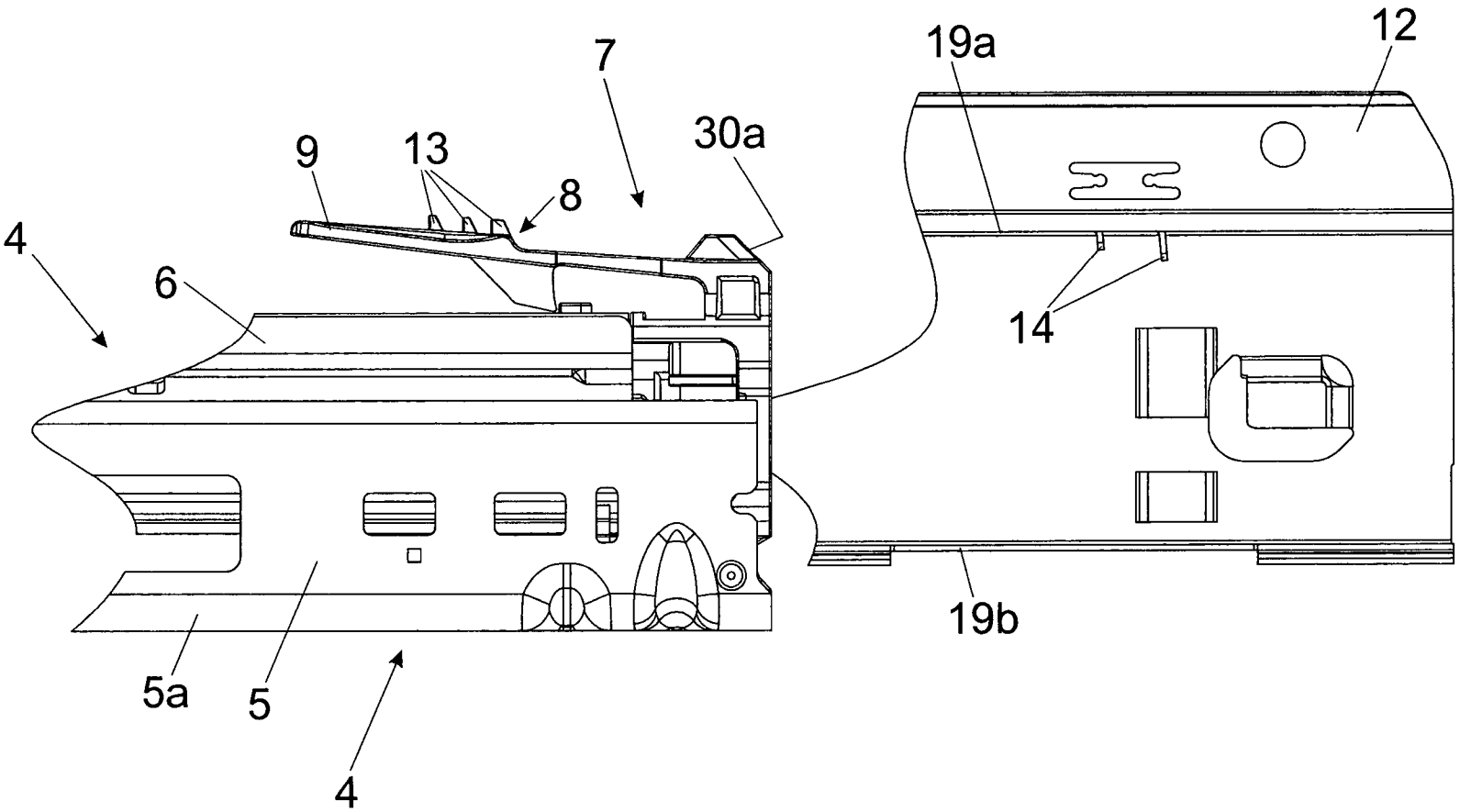
FIG. 6 shows mounting of the carrier rail to the drawer rail.
Figure 10:
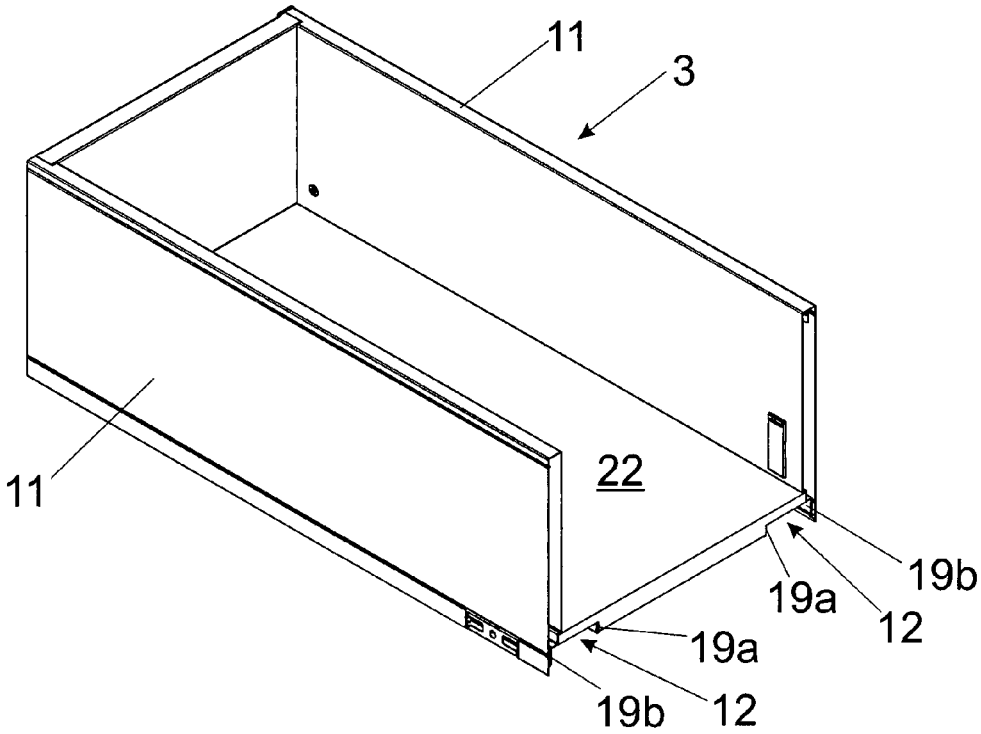
FIG. 10 shows a perspective view of a drawer with carrier rails pre-mounted thereto.

FIG. 6 shows a view from below of the drawer extension guide 4 with the carcass rail 5 and the drawer rail 6, showing mounting of the carrier rail 12 which is connected to the drawer 3. The carrier rail 12 has two vertically extending (i.e., protruding downwardly in a height direction of the drawer 3, as shown in FIG. 10) limbs 19*a* and 19*b*, the latching element such as the latching edges 14 on the first limb 19*a* projecting laterally in the direction towards the other (second) limb 19*b*. The first vertically extending limb 19*a* of the carrier rail 12 is deflected in the lateral direction upon mounting thereof by the inclined run-in portion 30*a*. In that way, the second limb 19*b* can be moved with a lateral spacing relative to the mounting flange 5*a* of the carcass rail 5 so that therefore the drawer side wall 11 (FIG. 3) cannot come into contact with the mounting flange 5*a* of the carcass rail 5, which flange is fixed to the furniture carcass 2, upon mounting of the drawer 3. That can therefore avoid damage to the outside surface of the drawer side wall 11.

Figure 7A:
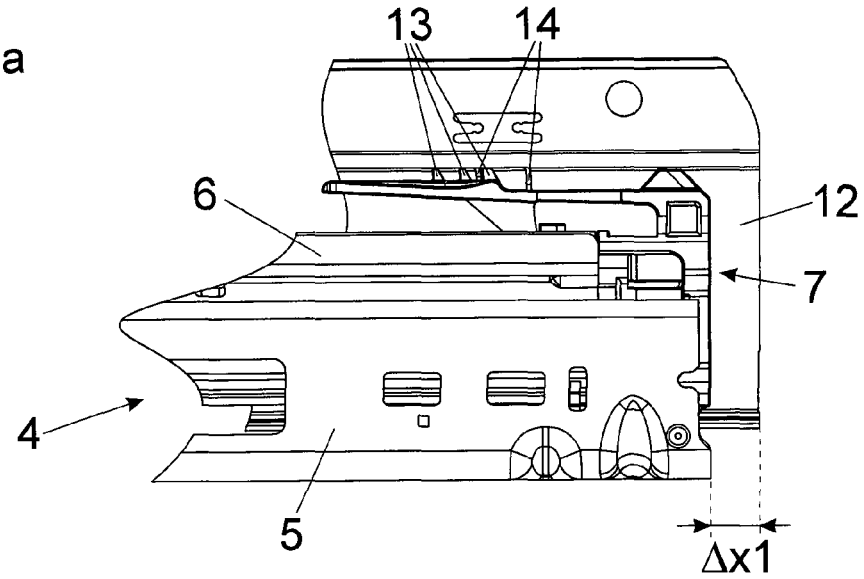
FIGS. 7*a*-7*c* show the carrier rail at three mutually different latching positions relative to the drawer rail.
Figure 7B:
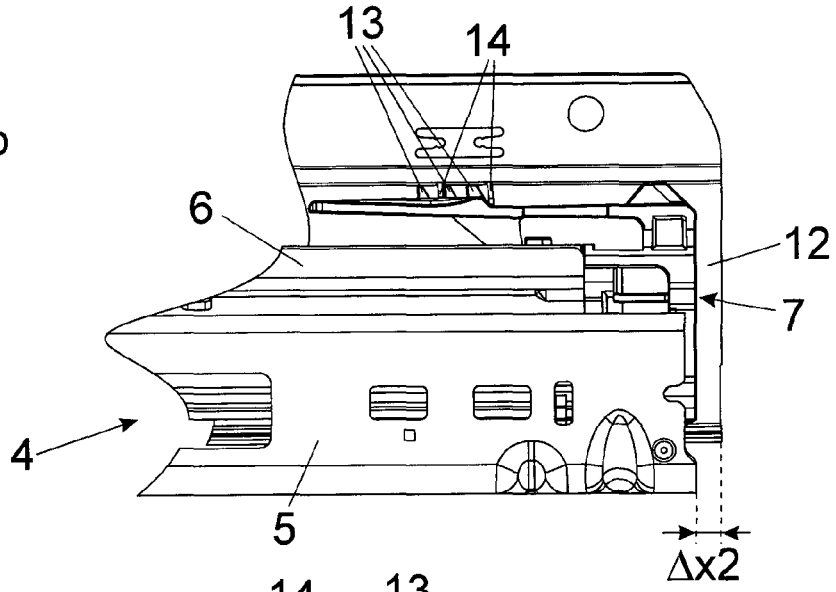
Figure 7C:
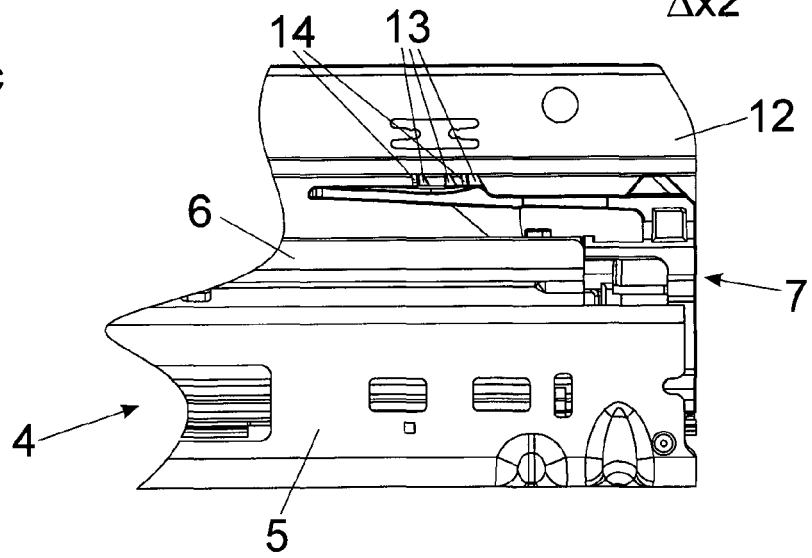

FIGS. 7*a*-7*c* each show a view from below of the drawer extension guide 4 with the carrier rail 12 connected thereto, the carrier rail 12 being fixed at various latching positions relative to the drawer rail 6. FIG. 7*a* shows a first depth position (Δx1) of the carrier rail 12 relative to the drawer rail 6, the latches 13 of the locking device 7 co-operating with the latching edges 14 of the carrier rail 12 in a first relative position. FIG. 7*b* shows a second depth position (Δx2) of the carrier rail 12 (and therewith the drawer 3) relative to the drawer rail 6, while FIG. 7*c* shows a third depth position of the drawer 3 relative to the drawer rail 6, in which the carrier rail 12 and the carcass rail 5 are substantially aligned with each other. Those various latching positions serve to connect the carrier rail 12 (and therewith the drawer 3) to the drawer rail 6 with as little play as possible to compensate for tolerances which occur. The latching action between the carrier rail 12 and the drawer rail 6 can be released again by manually applying pressure to the gripping element 9.

Figure 8:
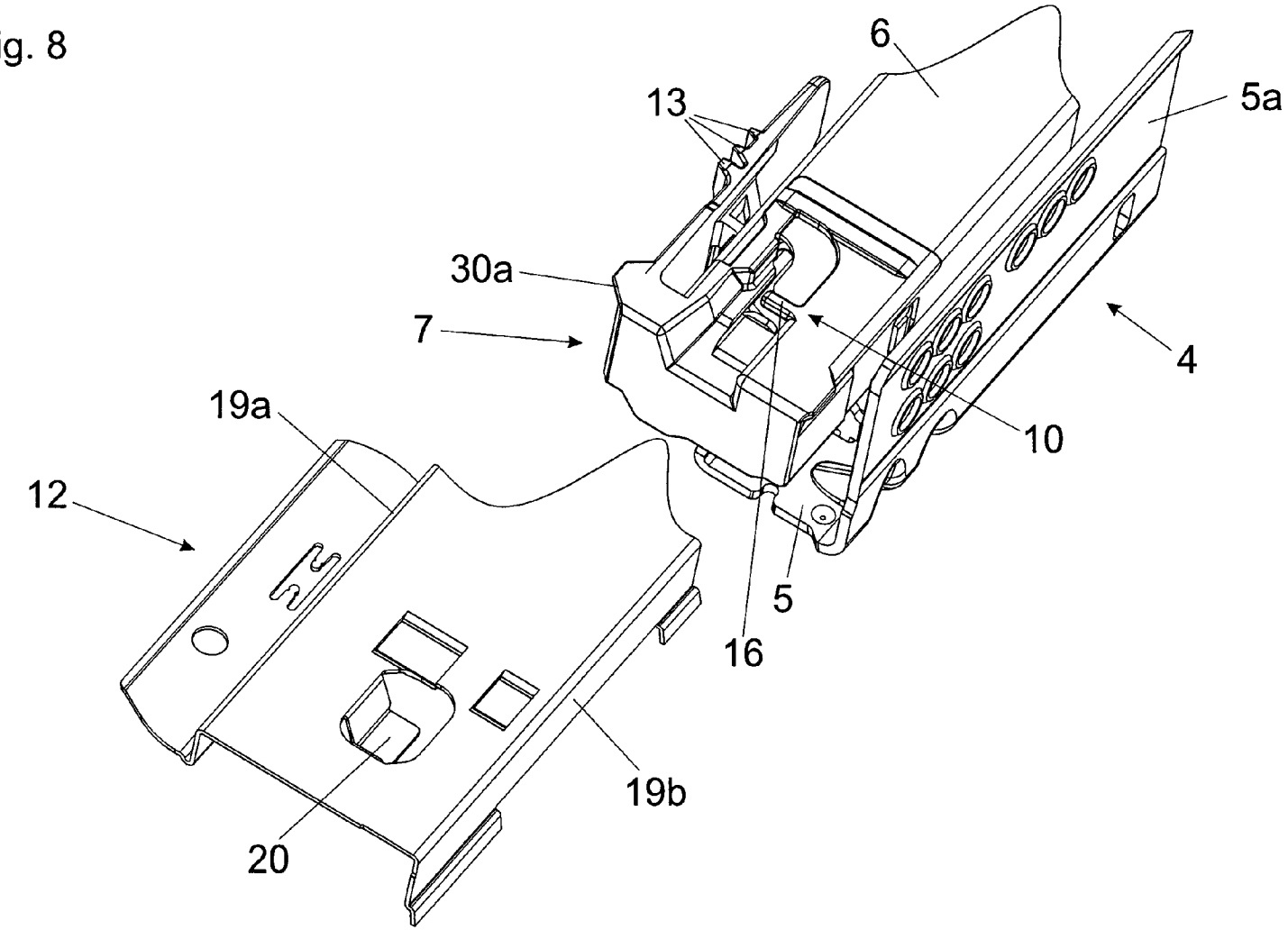
FIG. 8 shows a perspective view from above of the front end region of the drawer extension guide and the carrier rail to be connected thereto.

FIG. 8 shows the front region of the drawer extension guide 4 with the carcass rail 5 and the drawer rail 6 and the locking device 7 connected thereto, as a perspective view from above. The lifting prevention member 10 includes a leg 16 by which a pin 20 on the carrier rail 12 is prevented from moving in the height-wise direction so that therefore the front region of the drawer 3 cannot lift off the drawer rail 6 in the mounted position.

Figure 9:
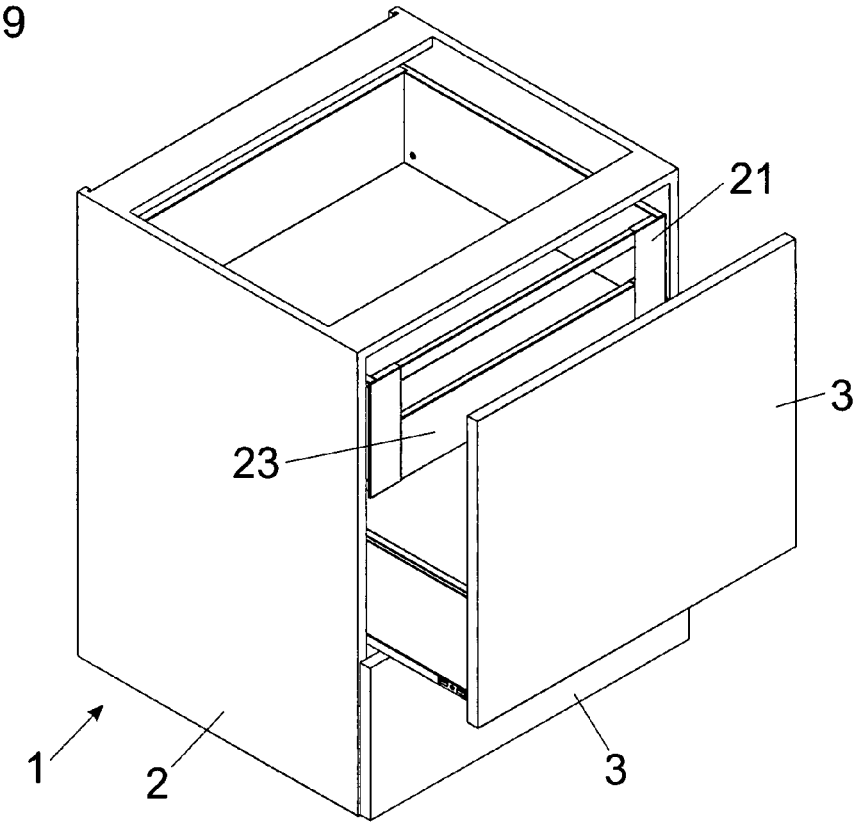
FIG. 9 shows a perspective view of an article of furniture having a front pull-out portion and an inner pull-out portion.

FIG. 9 shows a perspective view of an article of furniture 1 having a furniture carcass 2 and displaceable drawers 3. Both the drawer 3 with a front panel and also so-called internal drawers 21 can be fixed relative to the drawer rail 6 of the drawer extension guide 4 by way of the described locking device 7. The internal drawer 21 has a front wall 23 which does not bear against the front face of the furniture carcass 2, but is disposed in the closed position between the two side walls of the furniture carcass. For providing a defined position for the internal drawer 21 relative to the front face of the furniture carcass 2, the locking device 7 has a—preferably resilient—abutment 24 which is shown and described in FIGS. 11*a* and 11*b*.

FIG. 10 shows a perspective view of a drawer 3, wherein a respective carrier rail 12 is pre-mounted to the two lateral edge regions of the drawer 3. The carrier rails 12 are respectively connected to a side wall 11 and to a drawer bottom 22. It is possible to see the two vertically extending limbs 19*a* and 19*b* of the carrier rail 12, wherein the locking device 7 is releasably latchable relative to the limb 19*a* of the carrier rail 12.

Figure 11B:
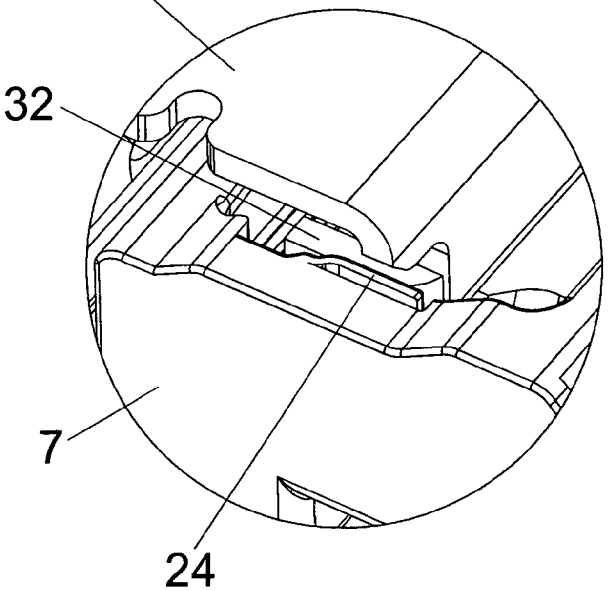
FIGS. 11*a*, 11*b* show the front end region of the drawer extension guide as a perspective view from below and an enlarged detail view.
Figure 11A:
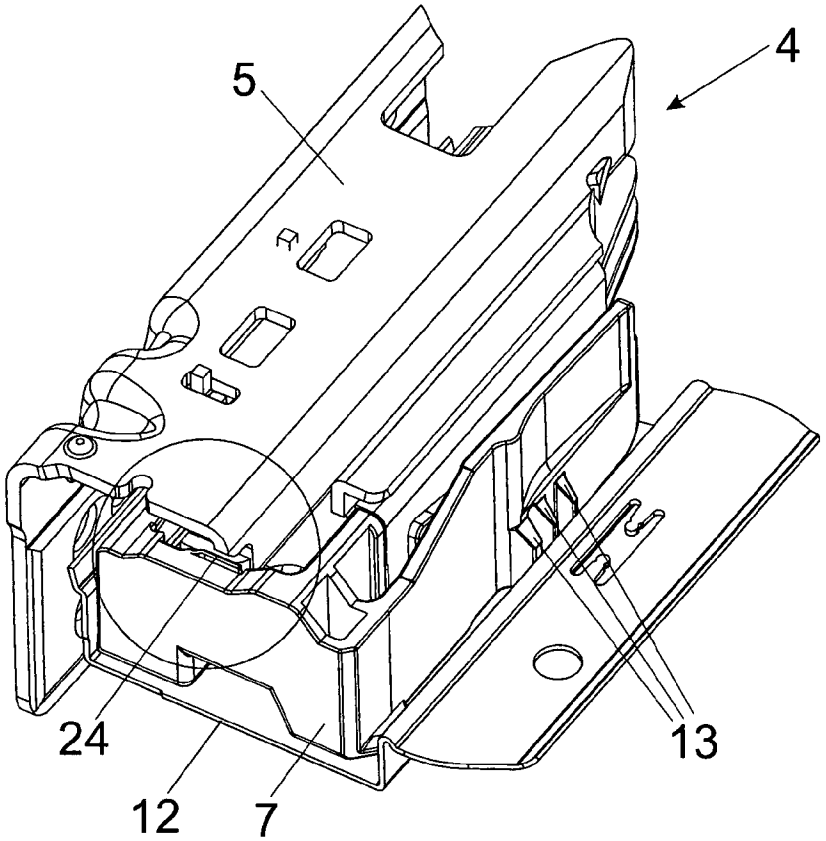

FIG. 11*a* shows a perspective view from below of the front region of the drawer extension guide 4, the latches 13 of the locking device 7 co-operating with the latching element (latching edges 14; not visible here) of the carrier rail 12. The locking device 7 further includes a resilient abutment 24 which in the closed position of the drawer rail 6 bears against the front of the carcass rail 5. That has the particular advantage that an internal drawer 21 (FIG. 9)—whose front wall 23 cannot bear against the front face of the furniture carcass 2—assumes a defined closed position relative to the front face of the furniture carcass 2. FIG. 11*b* shows an enlarged view of the region circled in FIG. 11*a*, wherein the abutment 24 of the locking device 7 bears against a bent-in leg 32 of the carcass rail 5. A further function of the abutment 24 is to provide that, in its closed end position, the drawer 3 is movable against the action of the abutment 24 in the direction of the furniture carcass 2. In other words, by virtue of the resilient abutment 24, the drawer 3 in the closed position can be pushed in by a predetermined distance (for example about 0.5 mm), in which case that release stroke movement is detected by an ejection device (not shown here) (in particular by a touch-latch fitment), whereupon the drawer 3 can be ejected by the ejection device from a closed end position into an open position. Those per se known touch-latch fitments can be used in particular in relation to drawers 3 whose front panel (for example, for aesthetic reasons) do not have any handle option or also in combination with an internal drawer 21 as shown in FIG. 9.

The present invention is not limited to the illustrated variants, but includes or extends to all variants and technical equivalents which can fall within the scope of the appended claims. The positional references adopted in the description such as for example up, down, lateral and so forth are also related to the directly described and illustrated Figure and are to be appropriately transferred to the new position. The locking device 7 for releasably arresting the drawer 3 relative to the drawer rail 6 can have a latching portion 8 which can be pivoted in and out in positively locking relationship relative to the drawer rail 6. The positively locking engagement can be formed by a latching portion 8 with pawls, tooth-like projections, hooks or claws—which co-operate with the drawer rail 6. The latching portion 8 is held in that engagement position in the secured position of the drawer 3 relative to the drawer rail 6 by spring force—in particular by inherent elasticity.

The invention claimed is:

1. An arrangement comprising:

a drawer having a drawer bottom, a drawer extension guide including:

a carcass rail to be fixed to a furniture carcass; and a drawer rail to be attached to said drawer, said drawer rail being mounted displaceably relative to said carcass rail;

a locking device on said drawer rail for releasably locking said drawer relative to said drawer rail, said locking device having a gripping element and a latching portion mounted movably via said gripping element between an arresting position in which said drawer is locked and a release position in which said drawer is released; and a carrier rail mounted to said drawer bottom, said carrier rail having a portion with a U-shaped cross-section having two vertical downwardly-protruding limbs extending along a longitudinal axis of said carrier rail, said portion of said carrier rail being configured to embrace said drawer rail from above, said latching portion of said locking device being releasably latchable to a latching element of at least one of said two vertical limbs of said carrier rail.

2. The arrangement according to claim 1, wherein said locking device is located at a front end region of said drawer rail.

3. The arrangement according to claim 1, wherein said gripping element is configured so as to pivot relative to said drawer rail.

4. The arrangement according to claim 1, wherein said locking device is configured so that said gripping element is located along a longitudinal side of said drawer rail.

5. The arrangement according to claim 1, wherein said gripping element is resilient and configured to project inclinedly from said drawer rail in a rest position.

6. The arrangement according to claim 1, wherein said gripping element and said latching portion are integrally formed to have a one-piece construction.

7. The arrangement according to claim 1, wherein said locking device has at least one inclined run-in portion configured to guide said drawer during mounting thereof in a lateral direction relative to said drawer rail.

8. The arrangement according to claim 1, wherein said latching portion has at least one latch co-operating with said latching element of said carrier rail in the arresting position, said latching element comprising one of a recess or a latching edge.

9. The arrangement according to claim 8, wherein said latching portion has at least two latches arranged offset relative to each other along the longitudinal axis of said carrier rail, said at least two latches being configured so that said drawer is releasably latchable relative to said drawer rail at two or more predetermined depth positions along said drawer rail.

10. The arrangement according to claim 1, wherein said locking device has a lifting prevention member configured to prevent lifting of a front end region of said drawer relative to said drawer rail.

11. The arrangement according to claim 10, wherein said lifting prevention member has an insertion opening at said locking device and configured to receive a pin connected to said drawer.

12. The arrangement according claim 1, wherein said locking device has a resilient abutment configured to, in a closed position of said drawer, bear against said carcass rail, said drawer being movable in a closed end position thereof against an action of said abutment in a direction toward the furniture carcass.

13. The arrangement according to claim 1, wherein said locking device includes a main body having a guide arranged thereon, said latching portion having a slide element configured to be slidingly supported against said guide.

14. The arrangement according to claim 1, wherein said locking device has a one-piece construction and is formed of plastic material.

15. The arrangement according to claim 1, wherein said latching portion is configured to, in the arresting position, co-operate with said latching element of said carrier rail, said latching element comprising one of a recess or a latching edge.

* * * * *